United States Patent [19]

Hosoi

[11] Patent Number: 4,877,708

[45] Date of Patent: Oct. 31, 1989

[54] ENCAPSULATED ELECTROSTATOGRAPHIC TONER AND METHOD FOR USE THEREOF

[75] Inventor: Noriyuki Hosoi, Fujinomiya, Japan

[73] Assignee: Fuji Photo Film Co., Ltd., Kanagawa, Japan

[21] Appl. No.: 137,827

[22] Filed: Dec. 23, 1987

[30] Foreign Application Priority Data

Dec. 25, 1986 [JP] Japan ..... 61-314424

[51] Int. Cl.[4] ..... G03G 13/06; G03G 9/08

[52] U.S. Cl. ..... 430/126; 430/138

[58] Field of Search ..... 430/102, 107, 109, 110, 430/138, 126

[56] References Cited

U.S. PATENT DOCUMENTS 4,497,886 2/1985 Herrmann et al. ..... 430/115

4,581,312 4/1986 Nakahara et al. ..... 430/110

*Primary Examiner*—John L. Goodrow

*Attorney, Agent, or Firm*—Jules E. Goldberg

[57] ABSTRACT

A toner employable for electrostatography which is in the form of micro-capsule comprises a core material enclosed with a resin shell. The core material contains a colorant and an oily medium wherein the oily medium contains chlorinated paraffin. A process for forming a visible image employing the toner is also disclosed.

8 Claims, No Drawings

ENCAPSULATED ELECTROSTATOGRAPHIC TONER AND METHOD FOR USE THEREOF

BACKGROUND OF THE INVENTION

1. Field of the Invention

The present invention relates to an encapsulated toner employable for producing a visible image from a latent image in an electrostatographic recording method and a process for forming a visible image employing the same.

2. Description of Prior Art

As the process for fixing a toner image in a recording method such as electrostatography, there have been known three fixing processes, that is, a heat fixing process, a solvent fixing process and a pressure fixing process. Recently, the heat fixing process and the pressure fixing process, both using no solvent, are widely used from the viewpoint of prevention of environmental pollution.

In the heat fixing process, a toner comprising a colorant dispersed in a binder has been conventionally employed. Such conventional toner has been also employed in the pressure fixing process. However, utilization of an encapsulated toner has recently proposed in the pressure fixing process.

The encapsulated toner is a toner in the form of micro-capsule prepared by enclosing a core material comprising a colorant such as carbon black and a binder with a resin shell which is rupturable by application of pressure.

The known encapsulated toner is not necessarily satisfactory in various properties essentially required for electrostatography.

As a material to be contained in the core material which is enclosed with a resin shell to form a microcapsule, an oily medium is widely used because of its high fixability. However, in the case of using the conventional oily material such as esters, aromatic substances and ether, the oily material contained in the capsule is liable to cause deterioration of a photosensitive material in the course of long-term running.

In the case of using an aliphatic oily material as the oily medium, the miscibility thereof with a component for forming a resin shell is low and hence thus prepared micro-capsule is not satisfactory in physical properties, though the aliphatic oily material less deteriorates the photosensitive material.

SUMMARY OF THE INVENTION

The present invention has an object to provide a novel encapsulated toner for electrostatography and a process for forming a visible image using said toner.

The invention has another object to provide an encapsulated toner which hardly cause deterioration of a photosensitive material and is improved in powder flowability, preservation stability, fixability and offsetting.

There is provided by the present invention a toner in the form of micro-capsule comprising a core material enclosed with a resin shell, said core material containing a colorant and an oily medium, which is characterized in that said oil medium contains chlorinated paraffin having 8–30 carbon atoms and chlorination degree of 8 to 40% by weight.

There is also provided by the invention a process for forming a visible image comprising the steps of producing an electrostatographic latent image on a latent image-retaining material, developing the latent image produced on the material to give a toner image, and transferring the toner image onto a sheet material to which the toner image is fixed, wherein the latent image-retaining material contains an organic photosensitive material, and the latent image is developed using a toner in the form of micro-capsule comprising a core material enclosed with a resin shell, said core material containing a colorant and chlorinated paraffin which has 8–30 carbon atoms and chlorination degree of 8 to 40% by weight.

The encapsulated toner of the present invention contains a chlorinated paraffin having 8–30 carbon atoms and chlorination degree of 8 to 40% by weight in the core material as the oily medium, so that the toner has the following advantage. That is, since the chlorinated paraffin less causes deterioration of a photosensitive material, superb visible images can be stably reproduced throughout long-term running. Particularly in the case of using an organic photosensitive material, remarkable effects can be obtained with respect to the abovementioned stable formation of toner images.

Further, the encapsulated toner of the invention has high flowability, because the core material is firmly enclosed with the resin shell to easily and well produce micro-capsules having a dense shell wall.

Moreover, the encapsulated toner of the invention shows a high preservation stability, so that an excellent visible image can be stably obtained even after a long time storage.

In addition to the above-described advantages features, the encapsulated toner of the invention shows a high fixability in a pressure fixing process of electrostatography. In more detail, when the encapsulated toner of the invention is ruptured on a paper sheet in the pressure fixing process, the organic solvent first wets an inside portion of the paper sheet to accelerate permeation of the colorant into inside of the paper sheet, and the colorant is accepted within the paper sheet within a shortened period of time. Accordingly, the fixing procedure can be done by applying a relatively low pressure, and hence it is possible to minimize volume of a total system of an electrostatographic apparatus, and fatigue of a paper sheet for receiving the toner image is reduced.

In the case of using only a solid binder such as solid polymer or wax with no oily medium, a colorant and the solid binder do not sufficiently permeate inside of the paper sheet, and a relatively large amount of the colorant and the binder remain on the surface of the paper sheet to produce protruding portions. Thus protruded colorant on one paper sheet is liable to move onto a surface of other paper sheet (i.e., toner-staining) when the paper sheet having the toner thereon is piled on other paper sheet, or liable to stain (or smear) a toner image when the toner image is rubbed with a finger or the like. However, according to the encapsulated toner of the invention using the specific oily medium, such toner-staining or smearing of duplicated toner image hardly takes place, because the colorant is firmly received inside of the paper shee as described above.

Further, the encapsulated toner of the invention is remarkably improved in off-setting phenomenon, so that members of an electrostatographic apparatus such as a press roller are not stained with the toner even in the long-term running.

DETAILED DESCRIPTION OF THE INVENTION

The encapsulated toner of the present invention can be prepared, for example, by the following process.

In the preparation of the encapsulated toner, micro-capsules are first produced. The micro-capsules can be produced by forming a resin shell around a droplet of a core material containing a colorant in an aqueous medium through an interfacial polymerization process, an internal polymerization process or an external polymerization process. This process for producing micro-capsules is already known.

Thus, the micro-capsules of the encapsulated toner according to the invention can be produced by a known method using known materials.

As a colorant contained in a conventional toner for an electrostatography, generally used are carbon black, grafted carbon black and a chromatic toner such as a blue, red or a yellow colorant. These conventional colorants can be also employed for the encapsulated toner of the invention.

The encapsulated toner of the invention may contain magnetic particles (i.e., magnetizable particles) in the core material.

As the magnetic particles, there can be employed magnetic particles (particulate material capable of being magnetized) for a conventional magnetic toner. Examples of the magnetic particles include particles of a simple metal (e.g., cobalt, iron or nickel), an alloy and a metallic compound. In the case of using a colored magnetic powder such as a powder of black magnetite, the colored magnetic powder can serve as magnetic particles as well as a colorant.

There is no specific limitation on a resin employable for forming a shell of the encapsulated toner, so long as the resin can form a dense shell around the core material dispersed in the form of oil droplets in an aqueous medium by means of any one of the interfacial polymerization process, internal polymerization process and the external polymerization process. From the viewpoint of various properties required for an encapsulated toner used in the pressure fixing process, preferred are polyurea resin, polyurethane resin, polyamide resin, polyester resin and epoxy resin. These resins can be employed singly or in combination. As the shell material of the encapsulated toner according to the invention, particularly preferred are polyurea resin, polyurethane resin and a mixture of polyurea resin and polyurethane resin from the viewpoint of the strength and the elasticity of the shell.

The process for producing the encapsulated toner of the invention will be described in detail hereinafter. The following description is given with respect to the preparation of encapsulated toners having a shell of polyurethane resin and/or polyurea resin.

Processes for producing micro-capsules by forming a shell of a polyurethane resin and/or of a polyurea resin around a droplet of a core material comprising a colorant and a binder (optionally, magnetic particles, etc.) in an aqueous medium are already known, and those conventional processes are employable to produce the encapsulated toner of the present invention, as described above.

For example, as the process for the preparation of micro-capsules using the polymerization reaction employable for producing the encapsulated toner, an interfacial polymerization process can be mentioned. Also, as other processes for producing micro-capsules using the polymerization reaction employable in the present invention, an internal polymerization process and an external polymerization process can be mentioned.

A shell of polyurea resin and/or polyurethane resin can be easily prepared by subjecting a polyisocyanate (e.g., diisocyanate, triisocyanate, tetraisocyanate or a polyisocyanate prepolymer) to the interfacial polymerization reaction in an aqueous medium in combination with a polyamine (e.g., diamine, triamine or tetraamine), a prepolymer having two or more amino groups, piperazine and a derivative thereof, or polyol in an aqueous solvent.

As the oily medium to be contained in the core material of the invention, there can be employed chlorinated paraffin generally having 8–30 carbon atoms and chlorination degree of 8 to 40% by weight, preferably having 14–26 carbon atoms and chlorination degree of 10 to 30% by weight.

When the value of carbon atom of the chlorinated paraffin is too small, an offensive smell is liable to be given or the resulting core material is difficulty enclosed with the shell. On the other hand, when the value of carbon atom thereof is too large, the resulting core material increases in the viscosity so as to hardly prepare a micro-capsule.

When the chlorination degree of the chlorinated paraffin is too low, the miscibility of the resulting core with the resin of constituting a shell lowers so as to hardly prepare a acceptable micro-capsule. On the other hand, the chlorination degree thereof is too high, the finally obtained toner is liable to cause deterioration of a photosensitive material.

The core material of the encapsulated toner according to the invention preferably contains a binder composed of a solid polymer (i.e., binder resin) in addition to the above-mentioned oily medium as a component for improving fixability.

Examples of the binder resin include polymers such as polyolefin, olefin copolymer, styrene resin, styrenebutadiene copolymer, epoxy resin, polyester, rubbers, polyvinylpyrrolidone, polyamide, coumarone-indene copolymer, methyl vinyl ether-maleic anhydride copolymer, amino resin, polyurethane, polyurea, homopolymers or copolymers of methacrylic acid esters, homopolymers or copolymers of acrylic acid esters, acrylic acid-long chain alkyl methacrylate copolymer oligomer, polyvinyl acetate, and polyvinyl chloride.

Among those polymers, particularly preferred are homopolymers or copolymers of acrylic acid esters, homopolymers or copolymers of methacrylic acid esters, and styrene-butadiene copolymer.

The solid polymer is preferably contained in the core material at a ratio by weight (the polymer to the chlorinated paraffin), of generally not more than 4, preferably in the range of 0.2 to 4, and more preferably in the range of 0.3 to 2.

The oily medium employed in the invention desirably contains an organic solvent substantially neither dissolving nor swelling the above-mentioned binder resin and having a boiling point of 100° C.–250° C. (hereinafter also referred to simply as non-dissolving organic liquid).

Examples of the non-dissolving organic liquids include saturated aliphatic hydrocarbons and mixtures of organic liquids mainly comprising saturated aliphatic hydrocarbons.

The encapsulated toner of the invention can contain known static charge modifiers such as silica powder, alumina powder and titanium dioxide powder on its surface.

For obtaining a visible image using the encapsulated toner of the invention, there can be utilized a known electrostatographic process. Examples of photosensitive materials used in the electrostatographic process include a-Se type photosensitive materials, ZnO type photosensitive materials, CdS type photosensitive materials, a-Si type photosensitive materials and organic photosensitive materials. Most preferred is the organic photosensitive material, because remarkable effects can be obtained in the electrostatographic process using the encapsulated toner of the invention.

There have been published various reviewing papers and patents for the photosensitive materials. Examples of such publications include "Electrostatographic Recording", Coloring Material 59-(11), pp 670–681, by Shinichiro Yasuda, 1986; "Non-impact Printing, General Technology Data File" by Soft Technique Research Publishing Division, Dec. 20, 1985; "Electronic Recording" by Managing System Laboratory; and "Hard Copy Technology" by Japan Industrial Technical Center, June, 1981.

The organic photosensitive materials are described, for example, in "PPC Organic Photosensitive Materials" of Electrostatographic Society Bulletin 25-(3), pp 290 296, 1986; and "Fundamentals of Organic Photosensitive Material" of Electrostatographic Society Bulletin 25-(3), pp 282–289, 1986.

The organic photosensitive materials are generally classified into three types, that is, (1) single layer type organic photosensitive material, (2) fine crystal-dispersed type organic photosensitive material and (3) laminated type organic photosensitive material. Among them, the laminated type organic photosensitive material is mainly used practically at present.

The laminated type organic photosensitive material consists essentially of a conductive support, a static charge generating layer and a static charge moving layer, superposed in this order.

As a material of the conductive support, aluminum is generally used from the viewpoint of high conductivity, low cost and lightweight properties.

The static charge generating layer comprises a resinous binder and a static charge generator dispersed in the binder. Examples of the resinous binder include polyvinyl butyral, polymethyl methacrylate, polyester, polyvinylidene chloride, polyamide, styrene-maleic anhydride copolymer and phenol resin. Examples of the static charge generator include condensation polycyclic pigments of perylene type of phthalocyanine type and azo pigments. Otherwise, Se or a-Si can be also employed as the static charge generator.

The static charge moving layer comprises a resinous binder and a static charge moving agent dispersed in the binder. Examples of the resinous binder include polysulfone, acrylic resin, methacrylic resin, polycarbonate, polyester, polyvinyl chloride, polyvinyl acetate, phenol resin, epoxy resin, alkyd resin and polyurethane resin. Examples of the static charge moving agent include heterocyclic compounds such as oxadiazole, oxazole and pyrazoline; triphenylmethane; triallylamine; and hydrazone.

The encapsulated toner of the invention can be effectively employed in combination with any of the above-described organic photosensitive materials.

An example of the present invention and a comparison example are given below.

EXAMPLE

In an automortar, 40 g. of a solution of chlorinated paraffin (value of carbon atom: 14, chlorination degree: 20 wt. %) containing 20 wt. % of polyisobutyl methacrylate (trade name: Acrybase, MM-2002-2; available from Fujikura Kasei Co., Ltd.) and 10 wt. % of polyisobutyl methacrylate (trade name: Acrybase, MM-2002-1; available fro Fujikura Kasei Co., Ltd.) and 70 g. of black pigment (trade name: Dyepyroxide Black #9510; available from Dainichi Seika Co., Ltd.) were mixed to prepare a dispersion (magnetizable ink).

Individually, in 60 g. of methyl acetate were dissolved 20 g. of paraffinic oil having a boiling point of 170° to 190° C., 3 g. of dimethylphenyl siloxane (trade name: Silicon KF50, 3,000 cs; available from Shinetsu Chemical Industries Co., Ltd.), 10 g. of an addition compound of 3 mol of hexamethylene diisocyanate and 1 mol of trimethylolpropane (trade name: Barnok D-950; available from Dainippon Ink Chemical Industries Ltd.) and 10 g. of an addition compound of 3 mol of toluylene diisocyanate and 1 mol of trimethylolpropane (trade name: Barnok D750; available from Dainippon Ink Chemical Industries Ltd.) to give a solution. The solution was mixed with the above-obtained magnetizable ink to prepare an oily dispersion. The preparation of the oily dispersion (mixture of core material and shell forming material) was done by keeping the dispersion at a temperature of not higher than 25° C.

To 200 g of 4% aqueous solution of methyl cellulose (methoxy group substitution degree: 1.8, mean molecular weight: 15,000) was added 0.2 g of diethylenetriamine to prepare an aqueous mixture. The temperature of the aqueous mixture was lowered to 15° C.

The above-mentioned oily dispersion was emulsified in the aqueous mixture to obtain an oil-in-water emulsion. The oil droplet had a mean particle size of approx. 12 μm.

At 10 minutes after the preparation of the emulsion, 50 g of 2.5 wt. % aqueous solution of diethylenetriamine was dropwise added into to the emulsion, and the mixture was stirred for three hours in a thermostatic chamber kept at 60° C. to complete an encapsulation reaction.

The obtained micro-capsule dispersion was subjected to centrifugal separation at 5,000 rpm to separate micro-capsules and an aqueous solution containing methyl cellulose (supernatant). The supernatant was then removed. To the obtained micro-capsule slurry was added water to give a 30% aqueous dispersion. The aqueous dispersion was again subjected to a centrifugal separation, and the obtained micro-capsule slurry was added with water to give a 30% aqueous dispersion. Such washing procedure comprising centrifugal separation and addition of water was repeated once more, and to the resulting microcapsule slurry was added 450 g. of water to prepare a micro-capsule dispersion.

To the obtained micro-capsule dispersion were added 12.5 g. of 1N nitric acid, 1.1 g. (0.006 mol) of ethylene glycol dimethacrylate and 0.75 g. (0.00125 mol) of cerium ammonium nitrite, and the resulting dispersion was stirred for 3 hours at room temperature to graft-polymerize the ethylene glycol dimethacrylate on the surface of the micro-capsules. The dispersion was subjected three times of washing procedures comprising centrifugal separation and addition of water, to give a micro-capsule slurry.

To the obtained micro-capsule slurry were successively added 450 g. of water, 0.4 g. (0.0015 mol) of potassium persulfate, 0.16 g. (0.0015 mol) of sulfurous acid soda and 5.2 g. (0.022 mol) of N,N-dibutylaminomethylstyrene, and the resulting dispersion was stirred three hours at room temperature to graft-polymerize the N,N-dibutylaminomethyl styrene on the surface of the micro-capsules.

The obtained micro-capsule dispersion was washed with water at 15 times by a decantation method, and to the dispersion was then added an aqueous dispersion of hydrophobic silica (RA-200H of Japan Aerogil Co., Ltd.) to give a dispersion containing silica in an amount of 0.5 wt. % based on the micro-capsules. The resulting dispersion was tried at 60° C. in an oven to prepare an encapsulated toner.

The obtained encapsulated toner was mixed with an iron powder carrier (DSP-132 of Dowa Iron Powder Industries Co., Ltd.), and the mixture was evaluated on a blow-off electrification property. The electrification degree thereof was +7 μq/g.

Subsequently, a negatively charged latent image was formed on an organic photosensitive material having been laminated on an aluminum drum according to the conventional electrostatographic process using copper phthalocyanine (static charge generator), a curable acrylic resin (resinous binder for a static charge generating layer), p-diethylaminobenzaldehyde (diphenyl hydrazone, static charge moving agent), and polycarbonate (resinous binder for a static charge moving layer). The latent image was developed by the use of the above-obtained two component developing agent (mixture of the encapsulated toner and the magnetic carrier) according to a magnetic blushing method. The developed image was then transferred onto an ordinary paper and fixed thereon by applying a pressure of 150 kg/cm$^2$.

It was confirmed that the obtained visible image was sharp and free from any fog. Also confirmed was that an image written with a pencil was sharply duplicated.

The obtained visible image was rubbed with a finger at 15 minutes after the fixing procedure, but any stain on the image was not observed.

Subsequently, the durability of the encapsulated toner was examined by performing continuous duplications of 20,000 times. It was confirmed that the density of the duplicated image hardly lowered even after the continuous duplications of 20,000 times. Further, the durability of the encapsulated toner was examined by performing continuous duplications of 30,000 times. It was also confirmed that substantial lowering of the density of the duplicated image causing a problem in practical use was not observed even after continuous duplication of 30,000 times (30,000 sheets).

COMPARISON EXAMPLE

The procedure of Example was repeated except for using diisopropylnaphthalene instead of chlorinated paraffin to prepare an encapsulated toner.

Using the obtained encapsulated toner, a process comprising the steps of developing, transferring the fixing was carried out in the same manner as described in Example.

It was confirmed that the visible image fixed on the paper was sharp and free from any fog. Also confirmed was that an image written with a pencil was sharply duplicated.

When the visible image was rubbed with a finger at 15 minutes after the fixing procedure, no stain on the image was observed.

Subsequently, the durability of the encapsulated toner was examined by performing continuous duplication. Some fog was observed on the duplicated image when the continuous duplications of approx. 5,000 times were done, and the density of the visible image lowered at the same time.

I claim:

1. In a toner in the form of microcapsule comprising a core material enclosed with a resin shell, said core material containing a colorant and an oily medium, the improvement which comprises said oil medium containing a chlorinated paraffin having from 8 to 30 carbon atoms and a chlorination degree ranging from 8 to 40% by weight.

2. The toner as claimed in claim 1, wherein a solid polymer is further contained in the core material and a ratio by weight of the polymer to the chlorinated paraffin is not higher than 4.

3. The toner as claimed in claim 1, wherein a solid polymer is further contained in the core material and a ratio by weight of the polymer to the chlorinated paraffin is in the range of 0.2 to 4.

4. The toner as claimed in claim 1, wherein a solid polymer is further contained in the core material and a ratio by weight of the polymer to the chlorinated paraffin is in the range of 0.3 to 2.

5. The toner as claimed in claim 1, wherein a solid polymer of polybutyl methacrylate is further contained in the core material and a ratio by weight of the polymer to the chlorinated paraffin is in the range of 0.2 to 4.

6. A process for forming a visible image comprising the steps of producing an electrostatographic latent image on a latent image-retaining material, developing the latent image produced on the material to give a toner image, and transferring the toner image onto a sheet material to which the toner image is fixed, wherein the latent image-retaining material contains an organic photosensitive material, and the latent image is developed using a toner in the form of micro-capsule comprising a core material enclosed with a resin shell, said core material containing a colorant and chlorinated paraffin which has 8–30 carbon atoms and chlorination degree of 8 to 40% by weight.

7. The process as claimed in claim 6, wherein said chlorinated paraffin has 8–30 carbon atoms and chlorination degree ranging from 8 to 40% by weight.

8. The toner as claimed in claim 6, wherein a solid polymer is further contained in the core material of the toner and a ratio by weight of the polymer to the chlorinated paraffin is not higher than 4.

* * * * *